United States Patent [19]

Coulson et al.

[11] 4,428,128

[45] Jan. 31, 1984

[54] JET TUBE DRYER RETAINER SYSTEM

[75] Inventors: Fred Coulson, Eagle Point; Jerry M. Smith, Portland, both of Oreg.

[73] Assignee: The Coe Manufacturing Company, Painesville, Ohio

[21] Appl. No.: 345,621

[22] Filed: Feb. 4, 1982

[51] Int. Cl.[3] ..... F26B 13/04

[52] U.S. Cl. ..... 34/155; 34/160

[58] Field of Search ..... 34/155, 160; 239/282, 239/283, 600

[56] References Cited

U.S. PATENT DOCUMENTS

| | | | |
|---|---|---|---|
| 2,828,552 | 4/1958 | Brendel et al. | 34/160 |
| 3,314,164 | 4/1967 | Morris | 34/155 |
| 3,334,421 | 8/1967 | Morris | 34/155 |
| 4,257,559 | 3/1981 | Noren | 239/600 |

*Primary Examiner*—L. I. Schwartz
*Assistant Examiner*—David W. Westphal
*Attorney, Agent, or Firm*—Klarquist, Sparkman, Campbell, Leigh & Whinston

[57] ABSTRACT

A jet tube dryer retainer system for adapting an existing jet tube dryer of the type using flanged jet tubes manufactured by Coe Manufacturing Co. to receive and retain flangeless replacement jet tubes in such a manner as to allow rapid removal and reinstallation of the replacement jet tubes, permit longitudinal expansion of the replacement jet tubes, and decrease the likelihood of future warpage and misalignment of the replacement jet tubes. Structural members for supporting the replacement jet tubes and strengthening the jet tube dryer frame are welded to the dryer frame at the air-delivery end and chain-drive end of each dryer section. A mounting post locates the narrow, closed end of the respective replacement jet tubes relative to the plane of the respective dryer decks and maintains the replacement tubes in a position which is fixed laterally and vertically while allowing slight longitudinal movement of the narrow closed end of the tube. Readily detachable retainer plates at the air-delivery end of the jet tube dryer secure the open ends of the jet tubes and substantially block entry of forced air into the dryer except through the replacement jet tubes.

4 Claims, 6 Drawing Figures

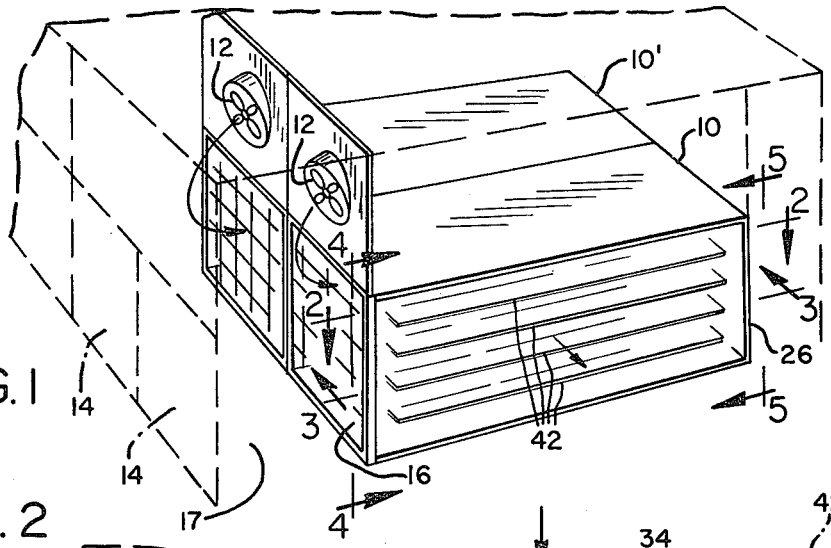
FIG. 1
FIG. 2
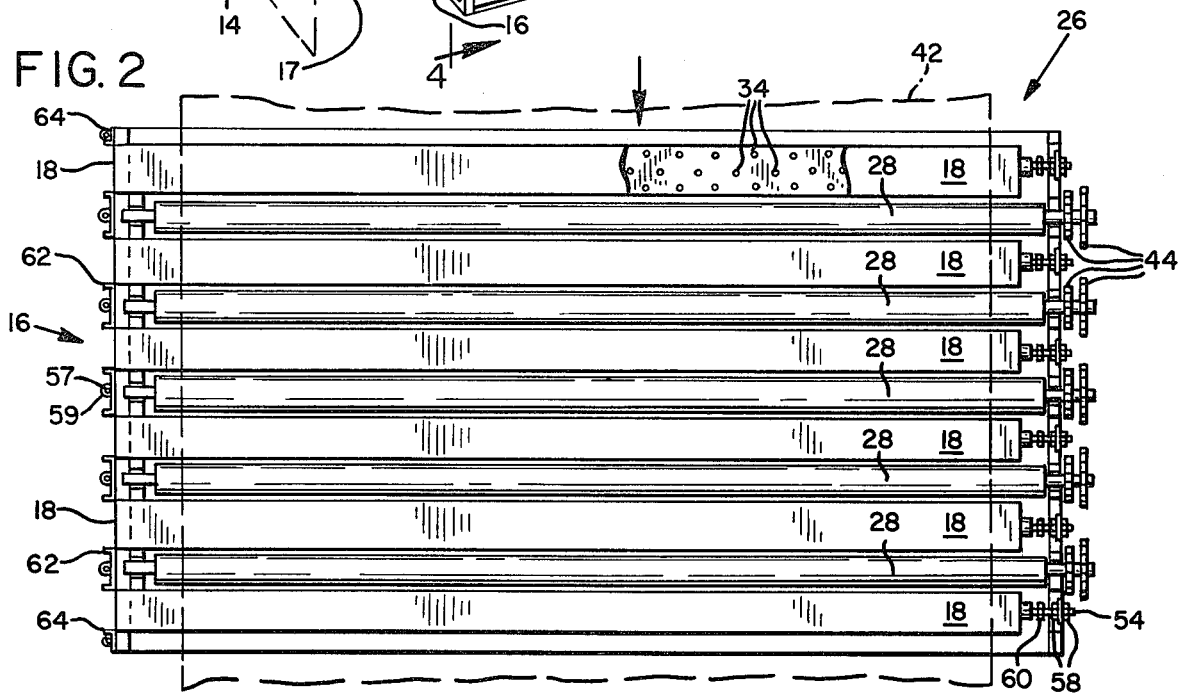
FIG. 3
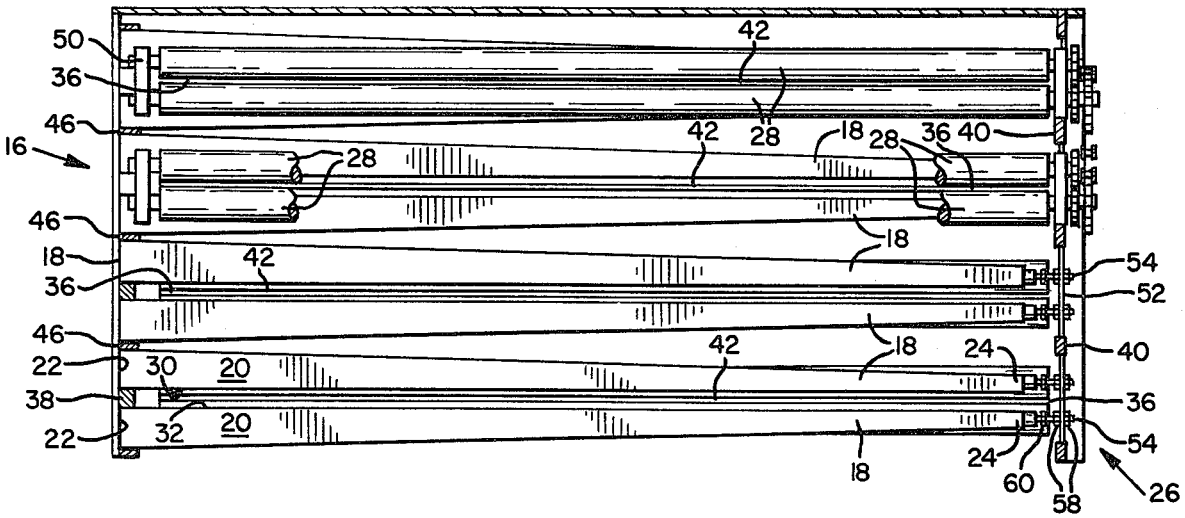

JET TUBE DRYER RETAINER SYSTEM

BACKGROUND OF THE INVENTION

This invention relates to a retainer system for converting a specific type of jet tube sheet dryer used to dry sheets such as wood veneer to enable such dryer to receive a specific type of replacement jet tube in a manner permitting rapid removal and reinstallation of the replacement jet tubes and more particularly to a retainer system for mounting the replacement jet tubes in such dryer so that the tubes are allowed to expand and contract longitudinally responsive to temperature changes in the dryer, while being maintained in a constant lateral and vertical position.

Jet tube dryers of the type manufactured by the Coe Manufacturing Co., of Painesville, Ohio, (hereinafter referred to as a "Coe jet tube dryer") are originally provided with an grid of elongate flanged jet tubes of generally rectangular cross-section, the vertical walls of which taper longitudinally from an open, air-delivery end to a narrow closed end. The jet tubes in the grid include flanged collars on the open end and mounting brackets on the narrow closed end. The generally rectangular dryer frame sections in a Coe jet tube dryer include lateral frame members at the air-delivery end which correspond to the dryer deck levels. The chain drive end of the dryer section has lateral frame members which are intermediate the dryer deck levels. In such dryer, horizontally-arranged pairs of opposed veneer rollers extending longitudinally between the air delivery end and chain drive end and are mounted to lateral frame members. The jet tubes also extend longitudinally from the air-delivery end of the dryer to the chain drive end, vertical pairs of jet tubes alternating laterally with vertical pairs of veneer rollers at each dryer deck level. The pairs of jet tubes are mounted in the dryer frame so that a longitudinally-extending bottom side of the upper tube of a pair is facing a parallel, longitudinally-extending top side of the lower tube of the pair. These parallel, facing, longitudinally-extending sides each have a plurality of holes formed therein. The holes formed in a longitudinally-extending side of the tapered jet tube serve to maintain a generally uniform measure throughout the length of the tube in an airstream flowing therethrough. A locus of points generally equidistant from each tube of the pair defines a horizontal plane equidistant from each roller of a roller pair, with each such plane in the dryer representing a dryer deck. The green (wet) veneer is supported and moved through the dryer by the roller pairs driven by a chain and sprocket arrangement while the tube pairs direct multiple jets of heated air at both the top and bottom of the veneer sheets.

The flanged collars on the open, air-delivery end of the jet tubes in the Coe dryer perform two functions. The tubes are installed into the dryer from the air-delivery end thereof and mounting brackets secure the narrow closed end of the respective jet tubes to a lateral frame member at the chain drive end of the dryer, with the flanged collar overlapping a dryer frame member at the air-delivery end and held against that member by the mounting bracket at the narrow end. The flanges also serve to substantially block entry of forced air into the dryer between the jet tubes, the flanges of adjacent jet tubes forming a grid face of open jet tubes and flanges on the air-delivery end of the dryer, and retainer plates being placed over the flanges to prevent movement of the jet tubes.

Fans, located above the dryer, force heated air down toward a dryer door, located a few feet from the air-delivery end of the dryer; which deflects the heated air into the open end of the jet tubes. The partially-enclosed area between the dryer doors and the air-delivery end of the dryer functions as a plenum where pressure is built up because of the greater capacity of the fans to direct heated air to the plenum than the jet tubes can bleed off. Thus pressurized heated air is directed at the green veneer moving through the dryer from the holes in the jet tubes.

One major problem with the Coe jet tube dryer is that both ends of the respective jet tubes are anchored so as to prevent longitudinal movement. Since the temperatures in the dryer can range from the ambient outside air temperature, when the dryer is off, to approximately 400°, the metal dryer tubes experience considerable expansion due to heat. The original tubes, being anchored at each end without room for longitudinal expansion, are subject to warping. So too does the metal dryer frame warp from the temperature gradient. Since each tube of a pair is anchored to a different lateral dryer frame member at the chain drive end, the warping of the dryer frame members can compound any misalignment of the jet tubes with respect to the plane of the dryer deck caused by the warpage of the tube. Thus, warpage of the jet tubes, the dryer frame, or both, can cause a "plug-up" in the veneer dryer when the tubes or dryer become sufficiently warped to block the flow of veneer. Since there is customarily only $\frac{3}{4}''$ to $1\frac{1}{4}''$ clearance between the green veneer going through the dryer and the jet tubes above and below the veneer, even small warpage of the tube when combined with small warpage of the lateral dryer frame member can easily, and commonly does, cause a plug-up in these types of jet tube dryers.

Another problem associated with the Coe jet tube dryer is that the overlapping flanges on the open, air-delivery end make it difficult and time-consuming to replace a warped tube or to remove the tubes to clear a plug-up. The overlapping flanges on adjacent tubes, necessary to block the entry of air into the dryer, require that several retainers be removed, and several tubes shifted in position or removed to allow removal of a single tube. This problem is especially prevalent in the vertical row of jet tubes adjacent to one of the sides of a dryer section. Dryers typically consist of multiple dryer sections arranged next to each so that the green veneer may roll from section into the other. The plenum area is partially defined by the floor, the dryer doors several feet in front of the air-delivery end of the dryer and the face of the air-delivery end of the dryer. The relatively long jet tubes adjacent to the sides of the dryer frame cannot be pulled straight out of the dryer because the flanges will not clear the doorpost which mounts the dryer doors. Instead, a center retainer must be removed, the rollers unbolted, and several tubes and rollers removed or slid laterally towards the center to allow the side tube to be taken out so that the flange can clear the doorpost.

Flangeless replacement jet tubes which have superior drying characteristics are available which would overcome this removal and replacement problem. These flangeless tubes taper similarly to the flanged tubes, but instead of a mounting bracket at the narrow end, the tubes include a reinforced bore therein generally parallel to the axis of the tube.

What is needed then is a jet tube retainer system which can adapt the existing Coe jet tube dryers to accept the flangeless replacement jet tubes, strengthen the dryer frame to prevent further warping of the frame, and mount the replacement jet tubes in the frame in such a way as to provide for longitudinal expansion of the jet tubes and also allow for rapid removal and reinstallation of the jet tubes.

SUMMARY OF THE INVENTION

The aforementioned problems are overcome by the present invention which provides a jet tube retainer system for retrofitting a Coe jet tube dryer to receive a flangeless type of jet tube.

In accordance with the retainer system of the present invention, lateral tube seat members are rigidly affixed to the air-delivery end of each dryer frame section intermediate the existing lateral frame members which are coplanar with the dryer decks. These tube seat members have flat upper surfaces for supporting a jet tube thereon. The tube seat cross members are also relatively thin in elevational cross-section to allow placement of a jet tube both above and below the tube seat member. Vertical strengthening members are rigidly affixed to these tube seat members and the dryer decks members above and below, providing overall strengthening of the dryer frame.

At the chain drive end of the dryer, vertical retainer bars are affixed between existing lateral frame members. These vertical retainer bars strengthen the dryer frame and ensure that the lateral frame members retain their position relative to each other. Two mounting posts are located on each retainer bar and extend into the dryer toward the air-delivery end, each post mounting one tube of each tube pair. The location of the mounting post on the retainer bar is calculated with respect to the horizontal plane which is equidistant from each roller of the roller pair and represents the dryer deck to ensure accurate placement of the jet tube pairs with respect to the veneer and correct any misalignment of the dryer frame caused by prior warpage.

An array of vertical retainer plates are detachably placed over the vertical sidewalls of the installed replacement jet tubes. The center retainer plates are wide enough to cover the space between laterally-adjacent jet tubes and overlap the vertical sidewalls thereof, but not so wide as to block or partially block the open end of the tube. The side retainer plates are wide enough to block entry of air into the dryer between the jet tube and the side posts, and overlap the vertical sidewall of the jet tube, but not so wide as to block or partially block the open end of the jet tube. Both center and side retainer plates have laterally elongate holes in them for receiving U-shaped shackles which are attached by their legs to the dryer deck frame members. The plates are attached to the dryer frame by means of a keeper pin or tapered key placed through the loop of the shackle.

In operation, the jet tubes are placed in the dryer from the air-delivery end so the bore in the narrow closed end of the jet tube is slidably mounted on the mounting post. The open ends of the tubes are arranged flush with the face the dryer at the air-delivery end and the retainer plates are attached preventing removal of the jet tubes.

A stop member, such as a nut, is located on the mounting post to limit movement of the jet tubes toward the chain drive end. This stop member is situated so as to allow for longitudinal expansion of the jet tube due to heat.

In order to remove a tube, even a tube adjacent to the side of the dryer, only two retainer plates must be removed by taking out the keeper pins. Removal of other tubes or lateral shifting of the tubes is not necessary since there are no flanges to interfere with removal of adjacent tubes or which prevent removal of a side tube because the flange will not clear the doorpost.

It is therefore a principal object of the present invention to provide a jet tube retainer system which allows placement of a flangeless replacement jet tube in a Coe jet tube dryer formerly using flanged jet tubes.

It is a further principal object of the present invention to provide such a jet tube retainer system which will accommodate longitudinal expansion of the jet tubes.

It is a still further principal object of the present invention to provide such a retainer system that will allow rapid removal and replacement of the jet tubes.

It is an associated object of the present invention to provide such a retainer system which also strengthens the dryer frame and reduces future warpage.

It is a further object of the present invention to provide such a retainer system which will realign the jet tubes with respect to the veneer drying decks.

It is a still further object of the present invention to provide such a retainer system which substantially prevents forced air from entry into the dryer except through the jet tubes.

The foregoing and other objectives, features, and advantages of the invention will be more readily understood upon consideration of the following detailed description of the invention, taken in conjunction with the accompanying drawings.

BRIEF DESCRIPTION OF THE DRAWINGS

FIG. 1 is a perspective view of two jet tube dryer sections also showing the fans, airflow and dryer doors.

FIG. 2 is a partially cutaway sectional plan view of a section of the dryer incorporating the present invention taken along lines 2—2 of FIG. 1.

FIG. 3 is a partially cutaway sectional side elevational view of a section of a dryer incorporating the present invention taken along lines 3—3 of FIG. 1.

DETAILED DESCRIPTION OF THE INVENTION

Figure 4:
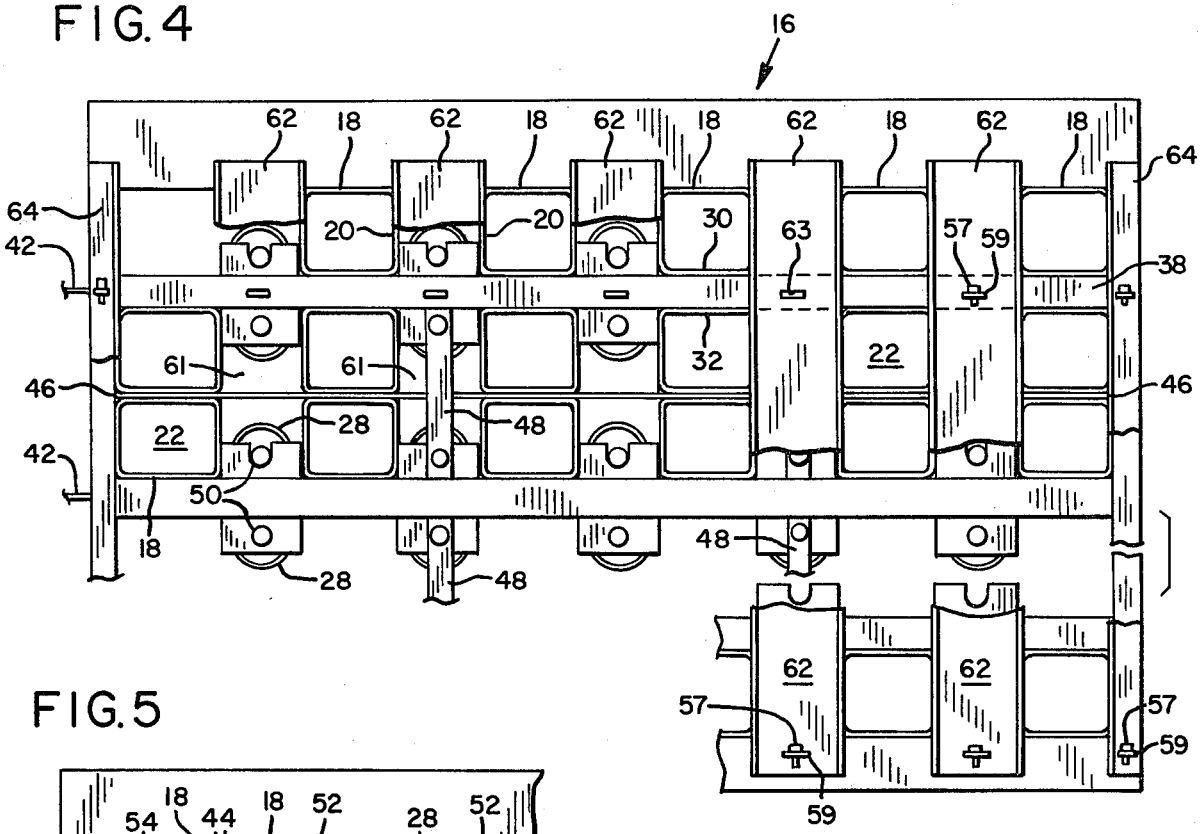
FIG. 4 is a fragmentary, partially cutaway, end elevational view of the air-delivery end of a section of dryer incorporating the present invention taken along lines 4—4 of FIG. 1.

The present invention provides a retainer system for adapting an existing jet tube dryer to receive and retain existing replacement jet tubes. FIG. 1 shows two generally rectangular dryer sections 10, 10' arranged adjacent to each other. A complete dryer will customarily consist of 12 of such dryer sections 10 arranged as shown in FIG. 1. The green veneer (not shown) or other material to be dried is moved through the dryer sections in a direction transverse to the longitudinal axis of each dryer section. Fans 12, usually located above the dryer sections, direct heated air from a hot air source down toward the dryer doors 14 located several feet in front of the air-delivery end 16 of the dryer section 10. The space between the dryer doors 14 and the air-delivery end 16 acts as a plenum 17 where pressure is built due to the capacity of the fans 12 to deliver more heated air to the plenum than the dryer can bleed off through the jet tubes 18, which are shown more clearly in FIG. 4. The plenum 17 equally distributes heated air under pressure to each of the jet tubes 18 in the air-delivery end 16 of the dryer section 10.

Figure 5:
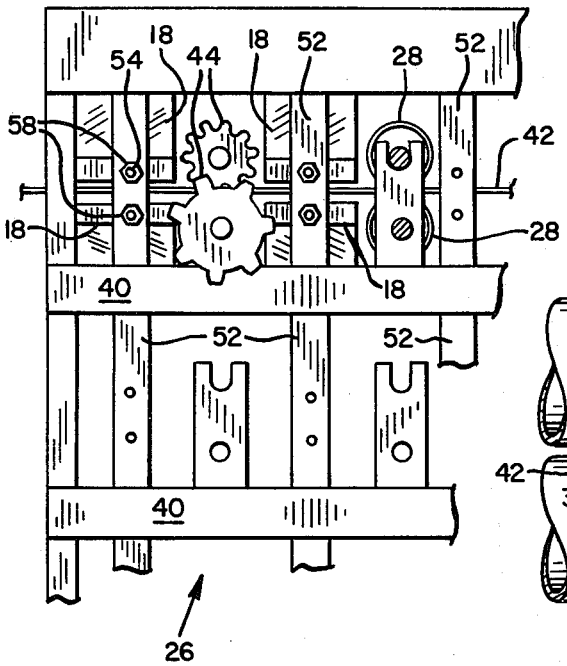
FIG. 5 is a fragmentary, partially cutaway, end elevational view of the chain drive end of a section of dryer incorporating the present invention taken along lines 5—5 of FIG. 1.

The jet tubes 18 shown in FIGS. 2, 3, 4 and 6 are elongate, tapered tubes of generally rectangular cross-section, the longitudinally-extending vertical sidewalls 20 of which taper longitudinally from the open end 22 of the jet tube 18 to a narrow generally closed end 24 as shown in FIG. 3. A grid of jet tubes 18 are arranged in the face of the air-delivery end 16 of the dryer section 10, as shown in FIG. 4, the open ends 22 of the jet tubes 18 forming a grid face, and the tubes 18 extending longitudinally toward the chain drive end 26 of the dryer section 10, which is shown in FIG. 5. Typically the grid face at the air-delivery end 16 of the dryer section 10 consists of forty-eight jet tubes 18, six arranged laterally across the grid face and eight arranged vertically. The vertical row of eight jet tubes 18 are arranged into four pairs of jet tubes, each lateral row of tube pairs representing a dryer deck 36.

Also arranged longitudinally in each dryer section 10 are pairs of veneer rollers 28 extending generally parallel to the jet tubes 18 from the air-delivery end 16 of the dryer section 10 to the chain drive end 26. Each dryer section 10 typically consists of forty rollers 28, five arranged laterally across the air-delivery end 16 and eight arranged vertically therein. Like the jet tubes 18, the vertical row of eight rollers 28 are arranged into four pairs of rollers. The rollers 28 alternate laterally with jet tubes 18 in a horizontal plane as shown in FIG. 2, each lateral pair of roller pairs also representing the dryer deck 36.

The jet tubes 18 are mounted in the dryer section 10 so that the longitudinally-extending bottom side 30 of the upper tube 18 of a pair is parallel to the facing longitudinally-extending top side 32 of the lower tube of a pair as shown in FIG. 3. These parallel facing sides 30 and 32 have numerous holes 34 formed therein as shown in FIG. 2. A horizontal plane, equidistant from these parallel facing sides 30, 32 and also equidistant from each roller 28 of a roller pair, defines a dryer deck 36. There are typically four such dryer decks 36 in these types of dryers. The air-delivery end 16 typically has four lateral dryer deck frame members 38 across the face thereof, which are generally coplanar with each dryer deck 36. The chain drive end 26 has similar lateral frame members 40 which are intermediate the dryer decks 36, rather than coplanar therewith. These lateral frame members 40 and lateral dryer deck frame members 38 serve to strengthen the dryer section 10 and provide mounting support for the jet tubes 18 and the rollers 28.

Figure 6:
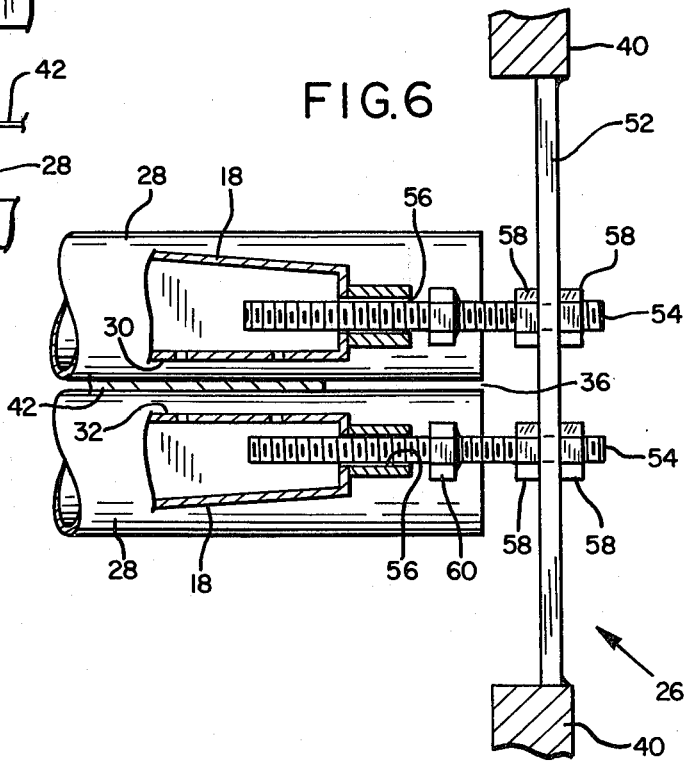
FIG. 6 is a fragmentary, partially sectional, side elevational view of the jet tube mounting system of the present invention at the chain drive end of the dryer.

Sheets of wood products such as green veneer 42 shown in FIGS. 4, 5, and 6 are carried through the dryer sections 10 by the pairs of opposed conveyor rollers 28 while pairs of jet tubes 18 direct a plurality of jets of heated air toward the top and bottom surfaces of the veneer 42 through the holes 34 formed in the parallel facing sides 30 and 32 of the jet tubes 18 as partially shown in FIGS. 2 and 6. Referring to FIG. 5, the rollers 28 are journaled to sprockets 44 which are rotated by a drive chain (not shown).

Turning now to the subject of the present invention, three lateral tube seat members 46 are rigidly affixed between the vertical side posts of the dryer section 10 intermediate the dryer deck frame members 38 at the air-delivery end 16 of the dryer as shown in FIG. 4. These tube seats 46 are preferably welded in place with additional support at the extremities thereof provided by small tabs (not shown) to ensure a strong rigid connection to the vertical side posts. Three of such tube seats are affixed to the dryer section 10 frame, one between each of the four dryer decks 36. The tube seats 46 have flat upper and lower surfaces and are relatively thin in elevational cross section so one jet tube 18 may sit thereon and another jet tube 18 fit beneath it, resting upon the dryer deck frame member 38.

Vertical strengthening members 48 extend between dryer deck frame members 38 and are rigidly affixed, preferably by welding to the dryer deck frame members 38 and the intermediate tube seat member 46. Preferably only six of these vertical strengthening members 48 are used, spanning the dryer deck frame members 38 so as to be superimposed over the veneer roller bearings 50 on alternate vertical columns of veneer rollers 28 as shown in FIG. 4.

At the chain drive end 26 of the dryer section 10 vertical retainer bars 52 are rigidly affixed, preferably by welding, between the lateral frame members 40. The retainer bars 52 as well as the tube seats 46 and vertical strengthening members 48 serve to strengthen the dryer frame and prevent further warpage due to thermal expansion of the dryer frame as a result of the temperature gradient. The dryer section 10 will typically be already warped at the time of the retrofit, requiring each vertical retainer bar 52 to be individually cut to measurement. Measurements must also be taken as to the location of the tube mounting posts 54 which are fixed to the retainer bar 52. Since there is customarily only $\frac{3}{4}''$ to $1\frac{1}{4}''$ clearance between the jet tubes 18 and the green veneer 42, it is crucial that the location of the mounting posts 54 on the retainer bar 52 be measured from the horizontal plane equidistant from each the roller 28 of a roller pair which represents the dryer deck 36 as can be seen in FIG. 6. This step will prevent misalignment of the jet tubes 18 with respect to the dryer deck 36 due to previous warpage of the lateral frame members 40. The retainer bar 52 and mounting posts 54 arrangement also ensures that the jet tubes 18 of a jet tube pair will maintain constant position with respect to each other. The previous system for the existing dryer mounted each jet tube 18 of a jet tube pair to a different lateral frame member 40. Warping of the lateral frame members 40 in such an arrangement caused misalignment of the tubes 18 of the pair with respect to each other and contributed to causing plug-ups.

The mounting posts 54 are preferably made from threaded bolt stock having a diameter smaller than the inner diameter of the reinforced bore 56 in the narrow closed end 24 of the jet tube 18 as shown in FIG. 6. Holes are formed in the retainer bar 52, and the mounting post 54 is rigidly attached to the retainer bar 52, preferably by threaded nuts 58 tightened on the mounting post 54 adjacent both sides of the retainer bar 52. A stop member 60, preferably another threaded nut, is fixed on the mounting post 54, also preferably by welding, in such a position as to limit the distance the tube 18 can move on the post 54 toward the retainer bar 52. The proper location of the stop member 60 is determined by first ensuring that the open end 22 of the jet tube 18 is flush with the dryer frame at the air-delivery end 16 of the dryer section 10, and then allow sufficient room to provide for longitudinal expansion of the tube 18 due to heat, but not so much room as to allow the tube 18 to slip off its support at the air-delivery end 16 by movement of the whole tube 18 toward the chain drive end 26. The distance between the closed end 24 of the tube 18 and the stop member 60 is customarily ⅜".

The dryer section 10 is filled with jet tubes 18 as shown in FIGS. 2, 3 and 4 so as to form four horizontal dryer decks 36, the lateral row of jet tubes 18 below each dryer deck 36 having holes in the top longitudinally-extending sides 32 thereof, while the lateral row of jet tubes 18 above each dryer deck 36 having holes in the bottom longitudinally-extending side 30 thereof as shown in FIGS. 3 and 4. The open end 22 of the upper jet tube of each pair rests on the dryer deck frame member 38, while the lower jet tube 18 of each pair rests on the tube seat 46. With all the jet tubes 18 arranged in the dryer section 10, there will be vertical rows of tubes 18 alternating laterally with vertical rows of rollers 28 across the air-delivery end 16 of the dryer, this arrangement leaving considerable open space 61 above and below each pair of rollers 28. The center retainer plates 62 and side retainer plates 64 serve to cover these open spaces in the face of the dryer section 10 as well as keep the jet tubes 18 in place.

The center retainer plates 62 are elongate members whose length approximates the height of the dryer section 10 and whose width is sufficient to cover the vertical sidewalls 20 of laterally adjacent jet tubes 18 and span the intermediate roller 28 as can been seen in FIG. 4. In cross section, the plates are C-shaped as shown in FIG. 2, the raised ribs or legs providing longitudinal rigidity. The surface of the plates 62 which faces the interior of the dryer 10 is flat, so that when the retainer plate 62 is in place, the open end 22 of the jet tube 18 cannot extend past the face of the air-delivery end 16 of the dryer. The two side retainer plates 64 are also elongate members having a length which generally approximates the height of the dryer face and having an L-shaped cross section as shown in FIG. 4. They are wide enough to cover the open space between the jet tube 18 and the side of the dryer and cover the vertical sidewall 20 of the jet tube 18 adjacent the side of the dryer section 10. As with the center retainer plate 62, the side retainer plates 64 are installed so that a flat side faces into the dryer. Both retainer plates 62, 64 have elongate holes 63 formed therein transverse to the longitudinal axis of the plate for receiving the loop of a generally U-shaped shackle 59 which is preferably welded by its legs to the dryer deck frame member 38. The elongate holes 63 on the plates 62 and 64 are appropriately spaced to receive the loops of the shackles 59. The retainer plates 62, 64 are then secured by a keeper pin 57 or tapered key.

Previous jet tubes had flanged collars around the open ends thereof to cover the open spaces between the open ends 22 of the jet tubes and block passage of heated air into the dryer except through the jet tubes. It was necessary to keep on hand as many as seven different kinds of flanged tubes in order to provide immediate replacement of any jet tube in the grid. In addition, the aforementioned difficulties with the removal and reinstallation of the flanged jet tubes took as much as four times the amount of repair time as does removal and reinstallation of the flangeless tubes with the present retainer system. Since the entire dryer must be shut down to replace one tube in one section of a dryer this is an important economic factor.

The terms and expressions which have been employed in the foregoing specification are used therein as terms of description and not of limitation, and there is no intention, in the use of such terms and expressions, of excluding equivalents of the features shown and described or portions thereof, it being recognized that the scope of the invention is defined and limited only by the claims which follow.

What is claimed is:

1. A retainer system for installing a grid of readily removable replacement jet tubes in a jet tube sheet dryer, said dryer having a dryer frame with multiple lateral dryer decks which include opposed pairs of sheet conveyor rollers extending transversely across the dryer for conveying sheets to be dried between said opposed pairs of rollers, and a plurality of pairs of longitudinally-extending replacement jet tubes, extending transverse to the sheet, each having a generally rectangular cross section, the vertical walls of which gradually taper longitudinally from an open, air-delivery end of the tube to a generally closed end which defines a small orifice therein so as to maintain generally uniform pressure throughout the length of the tube in an airstream flowing therethrough, each said replacement tube having a plurality of holes in the longitudinally-extending side thereof which is parallel to and closest to the corresponding side of the other tube of the pair so that each tube directs a plurality of airstreams toward the other tube of the pair at said sheets which are conveyed between said pair of jet tubes by said rollers, said retainer system comprising:

(a) tube seat means, laterally fixed intermediate the dryer decks and having a flat upper surface for supporting the replacement jet tubes thereon;

(b) a plurality of vertical strengthening members fixedly attached to the dryer frame and said tube seat means and located at the air-delivery end of the dryer;

(c) retainer plate array means detachably connected to the air-delivery end of the dryer for retaining the replacement jet tubes in the dryer frame and for preventing free passage of forced air into the dryer except through the holes of the jet tubes, said retainer plate array means being readily detachable for removal and reinstallation of the replacement jet tubes; and (d) replacement jet tube mounting means for detachably mounting the generally closed end of the respective tubes in a position which is fixed laterally and vertically with respect to the rollers while allowing longitudinal expansion movement of said closed end of the respective tubes.

2. The retainer system of claim 1 wherein said retainer plate array means comprises:

(a) a plurality of center retainer plate members vertically extending between the decks of the dryer frame so that each vertical edge of said center plate member is superimposed over the edge of a vertical wall of the open, air-delivery end of the respective replacement jet tubes so as to prevent removal of the tubes; and (b) a plurality of side retainer plate members vertically extending between the dryer decks proximate a vertical side wall of the dryer frame so that one vertical edge of said side retainer plate member is superimposed over the edge of a vertical wall of the open end of the replacement jet tubes so as to prevent removal thereof.

3. The retainer system of claim 1 wherein said replacement jet tube mounting means further includes:

(a) a retainer bar extending vertically between lateral dryer frame members, said retainer bar being rigidly attached to the lateral dryer frame members, and (b) a tube mounting post rigidly attached to said retainer bar, extending perpendicular to said retainer bar toward the closed end of the respective replacement jet tubes and through the orifice therein, said tube mounting post further including stop member means located thereon intermediate the respective tubes and said retainer bar for limiting the distance the closed end of the respective replacement jet tubes may move on said tube mounting post toward said retainer bar.

4. The retainer system of claim 2 wherein said center retainer plate members and said side retainer plate members are each detachably connected to the dryer frame by releasable attachment means including a sliding keeper member.

* * * * *